US008474670B1

(12) United States Patent
Gregory et al.

(10) Patent No.: US 8,474,670 B1
(45) **Date of Patent: *Jul. 2, 2013**

(54) HOLSTER RETENTION SYSTEM

(75) Inventors: Thomas M. Gregory, Belgrade, MT (US); Robert A. Kincaid, Bozeman, MT (US); Clifton L. Cook, Boise, ID (US); Eric M. Yeates, Virginia Beach, VA (US)

(73) Assignee: Alliant Techsystems Inc., Minneapolis, MN (US)

( * ) Notice: Subject to any disclaimer, the term of this patent is extended or adjusted under 35 U.S.C. 154(b) by 328 days.

This patent is subject to a terminal disclaimer.

(21) Appl. No.: 12/925,648

(22) Filed: Oct. 27, 2010

Related U.S. Application Data

(63) Continuation-in-part of application No. 11/030,270, filed on Jan. 6, 2005, now Pat. No. 7,841,497.

(51) Int. Cl.
*F41C 33/02* (2006.01)

(52) U.S. Cl.
USPC ..... 224/243; 224/912

(58) Field of Classification Search
USPC ..... 224/243, 244, 193, 911, 912
See application file for complete search history.

(56) References Cited

U.S. PATENT DOCUMENTS

| | | | | | |
|---|---|---|---|---|---|
| 2,349,376 | A | * | 5/1944 | Ray | 224/244 |
| 2,551,913 | A | * | 5/1951 | Toby | 224/244 |
| 3,910,469 | A | * | 10/1975 | Baldocchi | 224/198 |
| 4,318,503 | A | * | 3/1982 | Capano | 224/244 |
| 5,100,036 | A | * | 3/1992 | Rogers et al. | 224/244 |
| 5,419,474 | A | * | 5/1995 | Marx et al. | 224/244 |
| 5,518,155 | A | * | 5/1996 | Gallagher | 224/244 |
| 5,570,830 | A | * | 11/1996 | Nichols | 224/676 |
| 5,573,157 | A | * | 11/1996 | Mauriello et al. | 224/244 |
| 5,630,535 | A | * | 5/1997 | Valenti | 224/271 |
| 5,810,221 | A | * | 9/1998 | Beletsky et al. | 224/244 |
| 5,855,305 | A | * | 1/1999 | Nichols | 224/244 |
| 5,918,784 | A | * | 7/1999 | Serpa | 224/244 |
| 5,944,239 | A | * | 8/1999 | Rogers et al. | 224/193 |
| 6,085,951 | A | * | 7/2000 | Beletsky et al. | 224/243 |
| 6,112,962 | A | * | 9/2000 | Matthews | 224/243 |
| 6,588,639 | B2 | * | 7/2003 | Beletsky et al. | 224/672 |
| 6,641,009 | B2 | * | 11/2003 | French et al. | 224/244 |
| 6,732,891 | B2 | * | 5/2004 | Locklear, III | 224/244 |
| 6,752,300 | B2 | * | 6/2004 | Har-Shen | 224/244 |
| 6,769,582 | B1 | * | 8/2004 | Beletsky et al. | 224/244 |
| D501,991 | S | * | 2/2005 | Cook et al. | D3/222 |
| 6,854,626 | B2 | * | 2/2005 | Liao | 224/244 |
| 2001/0048009 | A1 | * | 12/2001 | Vor Keller et al. | 224/244 |
| 2002/0017541 | A1 | * | 2/2002 | French | 224/244 |
| 2002/0134803 | A1 | * | 9/2002 | Lowe et al. | 224/243 |
| 2002/0153396 | A1 | * | 10/2002 | French et al. | 224/244 |
| 2005/0035163 | A1 | * | 2/2005 | French et al. | 224/243 |
| 2005/0205624 | A1 | * | 9/2005 | French et al. | 224/244 |
| 2005/0279788 | A1 | * | 12/2005 | Lowe et al. | 224/244 |

* cited by examiner

*Primary Examiner* — Justin Larson
(74) *Attorney, Agent, or Firm* — Wooten & Shaddock, PLC

(57) ABSTRACT

A holster for a handgun, including a cavity having a frame/slide portion and a trigger guard portion; an axis extending between the frame/slide portion of the cavity and the trigger guard portion of the cavity; and a lever having a finger button portion and an engagement portion, wherein the lever includes a second side facing generally toward the holster cavity, and wherein the engagement portion of the lever includes a locking projection extending from the second side of the engagement portion; wherein the lever is pivotally attached atop the side wall of the holster, along the axis, approximately between the finger button portion and the engagement portion, such that the finger button portion extends from the axis and is positioned above the frame/slide portion of the cavity and the engagement portion extends from the axis and is positioned above the trigger guard portion of the cavity.

20 Claims, 10 Drawing Sheets

HOLSTER RETENTION SYSTEM

CROSS-REFERENCE TO RELATED APPLICATIONS

This is a Continuation-In-Part of U.S. patent application Ser. No. 11/030,270, filed Jan. 6, 2005, which issued on Nov. 30, 2010 as U.S. Pat. No. 7,841,497 the disclosure of which is incorporated herein in its entirety by reference.

BACKGROUND OF THE INVENTION

1. Field of the Invention

This invention relates generally to handgun holsters. In particular, the present invention relates to a handgun holster having a retention system.

2. Description of Related Art

Many users of handguns, particularly military and law enforcement personnel, carry a handgun in a holster designed to protect the handgun and hold it securely. Holsters can be worn in a number of ways, such as on a belt at the waist, on the thigh, under an arm, or around an ankle.

Certain users of handguns must be able to quickly and easily remove the handgun from a holster regardless of the type of holster used. Additionally, these users need to be assured that, when not in use, the handgun will remain safely in the holster.

Some holsters rely solely on friction to secure the handgun in place. This combination might not be suitable for situations where the gun/holster is subject to a great deal of movement because such movement could cause the handgun to lose frictional engagement with the holster.

Certain other holsters include a variety of strap or flap arrangements that prevent the removal of the firearm from the holster while the strap or flap is in place. With designs that rely on this method to retain a handgun, a user must first unfasten and/or rotate the strap/flap before the firearm can be withdrawn. Then, to re-secure the handgun in the holster once the handgun has been re-holstered, the user must physically refasten and/or rotate the strap/flap before the firearm is securely retained within the holster. Some users might not prefer these designs because of the time required to release and/or re-secure the handgun.

SUMMARY OF THE INVENTION

The present invention relates generally to handgun holsters. In particular, the present invention relates to a holster for a weapon, such as, for example, a handgun, having a retention system for securing a handgun such that the handgun is retained or locked in the holster when the retention system is engaged, but may be easily removed from the holster by the wearer while removal by anyone other than the wearer is difficult.

In an illustrative, non-limiting embodiment of this invention, the handgun holster comprises a handgun holster having a retention system. The retention system comprises a lever having an engagement end and a finger button end, the engagement end includes a locking projection for engaging an interior portion of the trigger guard of the handgun in the holster and, thereby, retaining the handgun in the holster.

The construction of the holster prevents the locking projection from contacting the trigger of the handgun by limiting how far the handgun can be inserted into the holster. The construction of the holster further facilitates alignment of the trigger guard with the locking projection by limiting movement of the handgun with respect to the lever.

The lever is positioned on the holster such that, when a user depresses the appropriate portion of the lever, thereby releasing the handgun from the holster, and draws the handgun from the holster, the user's index finger is positioned to contact the frame of the handgun, above the trigger guard.

In an illustrative, non-limiting embodiment of this invention, a biasing element is optionally included. If included, the biasing element contacts a front portion of the handgun's trigger guard and is spring-biased when the handgun is retained, or locked, in the holster. The biasing element biases the handgun out of the holster and assists in maintaining contact between the locking projection and the trigger guard. Furthermore, the biasing element may assist in removal of the handgun from the holster when the locking projection is disengaged from the trigger guard.

In one illustrative, non-limiting embodiment of this invention, the holster includes a cavity having an open top end, a bottom end, a frame/slide portion, and a trigger guard portion. The frame/slide portion of the cavity has greater depth than the trigger guard portion of the cavity. An axis extends between the frame/slide portion of the cavity and the trigger guard portion of the cavity.

A lever having a finger button portion and an engagement portion is pivotally attached atop the side wall of the holster, along the axis, approximately between the finger button portion and the engagement portion, such that the finger button portion extends from the axis and is positioned above the frame/slide portion of the cavity and the engagement portion extends from the axis and is positioned above the trigger guard portion of the cavity.

The lever includes a second side facing generally toward the holster cavity, and the engagement portion of the lever includes a locking projection extending from the second side of the engagement portion; wherein the lever.

In certain illustrative, non-limiting embodiment of this invention, the holster further includes one or more ridge segments extending from the side wall around at least a portion of the lever so as to define a recess. The lever is positioned within the recess and an aperture formed in a portion of the side wall beneath at least a portion of the finger button portion of the lever, wherein the aperture is formed within the recess.

Thus, the present invention automatically locks the handgun in place in the holster with a releasable mechanism that is easily operated by a wearer of the holster. However, the present mechanism is not easily accidentally disengaged or disengaged by anyone other than the wearer.

Accordingly, this invention provides a handgun holster, having a retention system.

This invention separately provides a safe and reliable quick-release handgun holster.

This invention separately provides a handgun holster having a retention system, which is capable of retaining a handgun securely in the holster while permitting a quick release of the handgun when the user requires.

This invention separately provides a handgun holster having a retention system, which is simple to operate.

This invention separately provides a handgun holster having a retention system, which automatically secures the handgun in the holster upon seating of the handgun in the holster, without requiring any additional operation by the user.

This invention separately provides a handgun holster and a retention system that assists the user in positioning his or her index finger along the frame of the handgun, outside of and not on the trigger guard, as the handgun is drawn from the holster.

This invention separately provides a handgun holster having an optional passive retention system, which can be tightened to provide increased frictional tension between a portion of the holster and the handgun trigger guard without increasing the frictional tension between a remaining portion of the holster and the handgun.

This invention separately provides a handgun holster, which is capable of being manufactured using injection molding production techniques.

These and other features and advantages of this invention are described in or are apparent from the following detailed description of the exemplary embodiments.

BRIEF DESCRIPTION OF THE DRAWINGS

The exemplary embodiments of this invention will be described in detail, with reference to the following figures, wherein like reference numerals refer to like parts throughout the several views, and wherein.

DETAILED DESCRIPTION OF EXEMPLARY EMBODIMENTS

Figure 1:
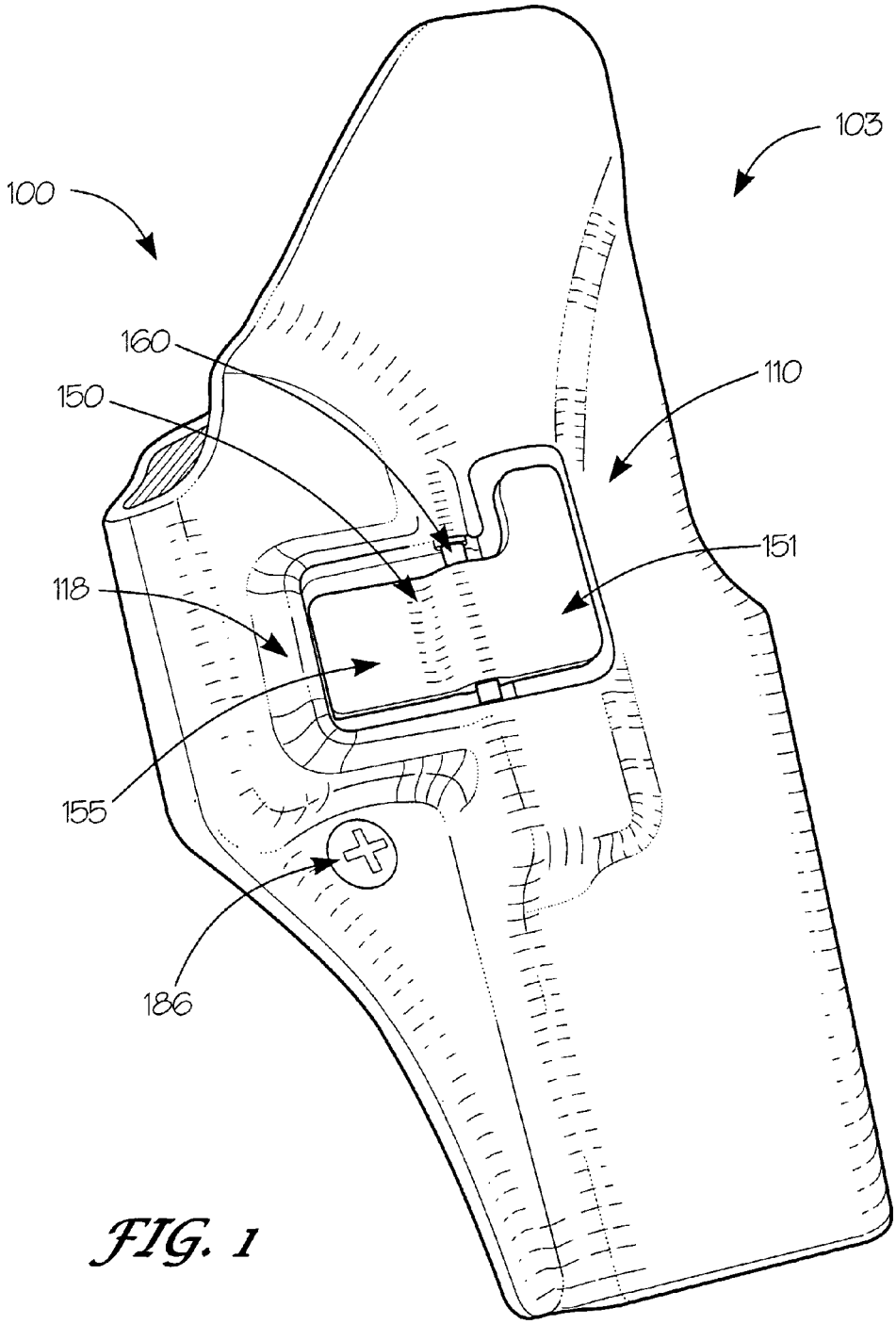
FIG. 1 shows a right perspective view of a first exemplary embodiment of a handgun holster having a retention system according to this invention.
Figure 2:
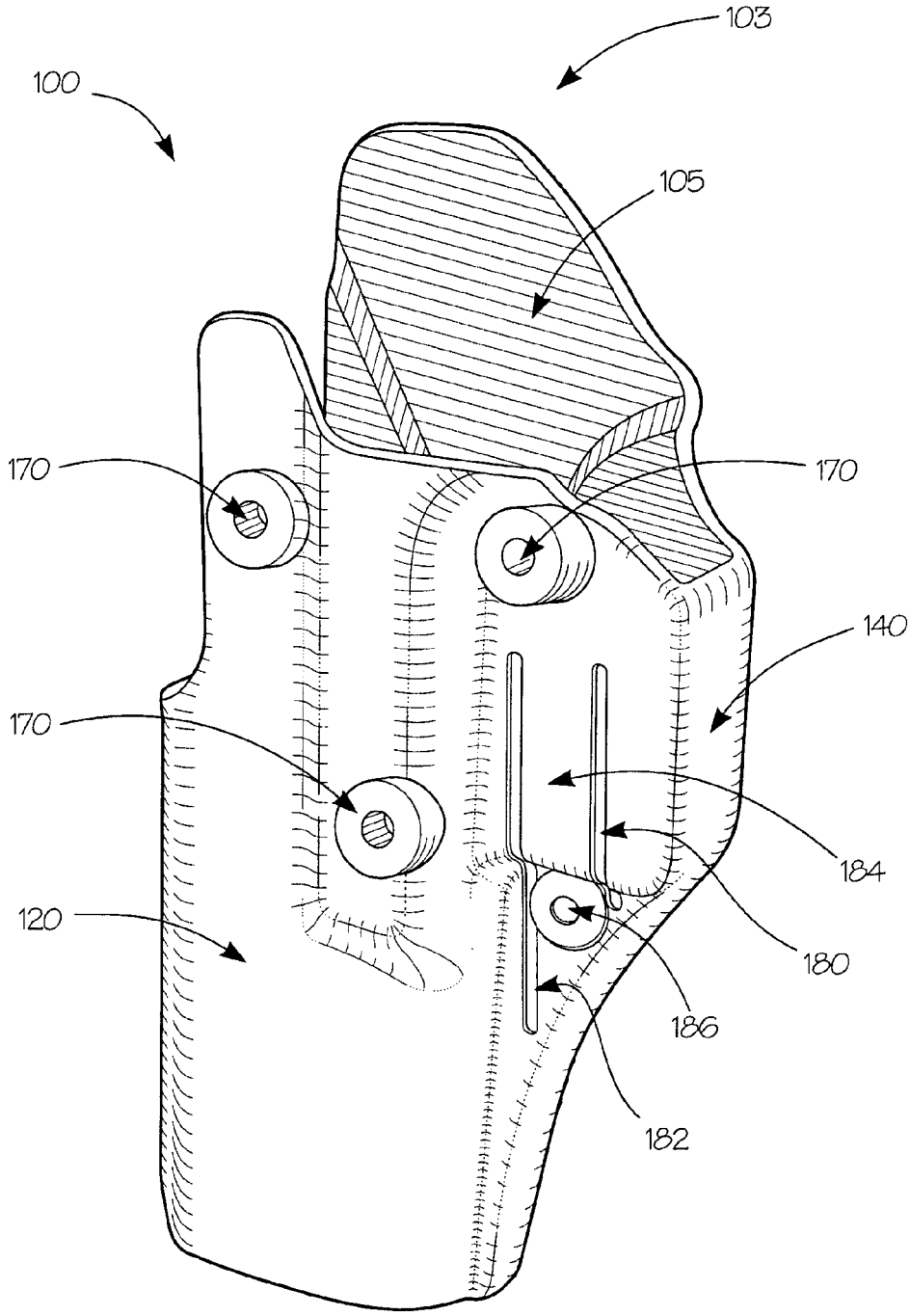
FIG. 2 shows a left perspective view of a first exemplary embodiment of a handgun holster having a retention system according to this invention.

For simplicity and clarification, the design factors and operating principles of the handgun holster according to this invention are explained with reference to various exemplary embodiments of a handgun holster according to this invention. The basic explanation of the design factors and operating principles of the handgun holster is applicable for the understanding, design, and operation of the handgun holster of this invention.

Furthermore, it should be appreciated that, for simplicity and clarification, the embodiments of this invention will be described with reference to a semiautomatic-type handgun being secured within the present holster. However, it should be appreciated that the operating principles of the handgun holster of this invention may also be employed to construct holsters or holders for any revolver or semiautomatic-type handgun, edged weapons as well as less than lethal products (i.e., tasers, pepper spray, mace canisters, or batons), so long as these items have an appropriate ledge or void that may be engaged or retained by a locking projection or other retaining means. Furthermore, it is also within the scope of the present invention that the present holster may be employed as a pouch for tactical accessories, such as ammunition magazines and/or flashlights, as well as for everyday items such as cell phones or personal digital assistants.

It should also be appreciated that the terms "handgun", "handgun holster", and "weapon" are used for basic explanation and understanding of the operation of the systems, methods, and apparatuses of this invention. Therefore, the terms "handgun", "handgun holster", and "weapon" are not to be construed as limiting the systems, methods, and apparatuses of this invention.

FIGS. 1-9B show various views of a first, illustrative, non-limiting embodiment of a handgun holster 100 having a retention system according to this invention. It should be appreciated that the holster 100 is adapted to retain a semiautomatic-type handgun. The semiautomatic-type handgun includes a slide, a grip, a trigger, and a trigger guard. The trigger guard includes an inner surface, which defines an area wherein the trigger is located and allows a user's finger access to the trigger, and an outer surface, which defines the outer perimeter of the trigger guard.

As shown in FIGS. 1-9B, the holster 100 includes a body 103 defining a cavity 105 for receiving and holding the handgun. The body 103 comprises a pair of opposed side walls comprising a first side wall 110 and a second side wall 120. Typically, the first side wall 110 is considered the outer side of the holster and is worn away from the user's body, while the second side wall 120 is considered the inner side of the holster and is worn against or adjacent the user's body.

In various exemplary embodiments, the body 103 further comprises at least some of a front wall 130 and a rear wall 140. However, it should be appreciated that the holster 100 may be formed such that one or more of the first side wall 110, the second side wall 120, the front wall 130, and/or the rear wall 140 is/are sufficient to define the cavity 105 for receiving the handgun and the remaining walls are not included.

The cavity 105 includes an open top end 101 and a bottom end 102 and may be formed from any number or combination of walls, including, for example, a single, continuous wall or multiple coupled or joined walls. Thus, the cavity 105 may be formed by any cavity, space, or platform that is capable of retaining a handgun.

Figure 3:
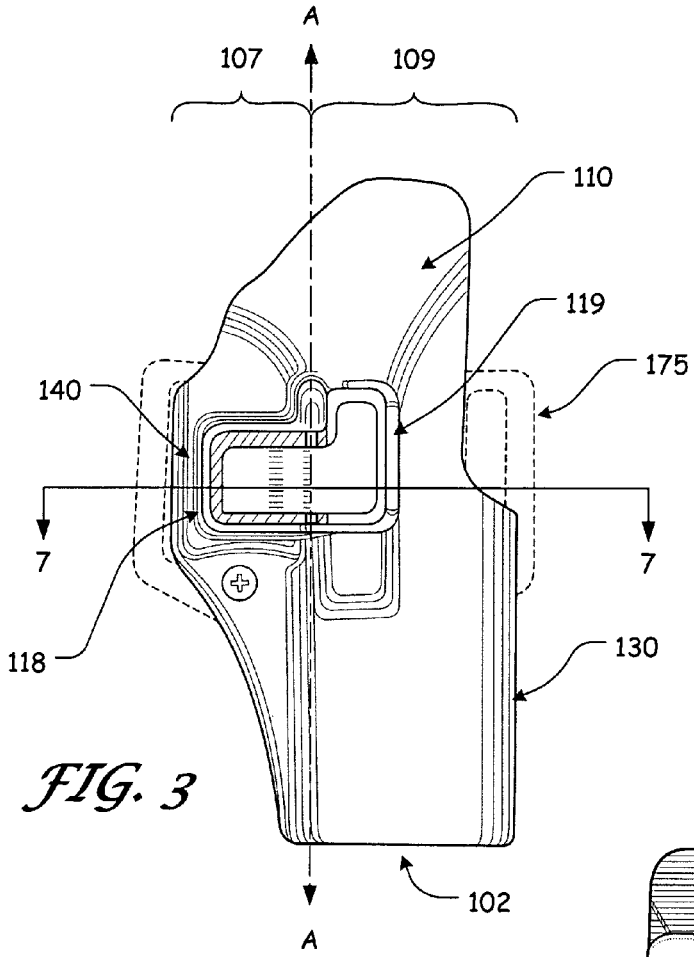
FIG. 3 shows a right side elevation view of a first exemplary embodiment of a handgun holster having a retention system according to this invention.

As identified in FIG. 3, an axis A extends generally from the top end 101 to the bottom end 102, between a frame/slide portion 109 of the cavity 105 and a trigger guard portion 107 of the cavity 105. The frame/slide portion 107 of the cavity 105 generally has greater depth than the trigger guard portion 109 of the cavity 105.

It should be noted that the walls of the holster 100 may generally be planar. Alternatively, the walls of the holster 100 may be contoured or shaped to better accommodate a specific type or model of handgun to be retained within the holster 100.

In various exemplary embodiments, the holster 100 is substantially rigid and is formed of a polymeric material such as a polymeric composite. Alternate materials of construction may include one or more of the following: steel, aluminum, titanium, and/or other metals, as well as various alloys and composites thereof, glass-hardened polymers, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset sheet materials, or the like, and/or various combinations of the foregoing.

Thus, it should be understood that the material or materials used to form the holster 100 and/or various components of the holster 100 is a design choice based on the desired appearance and functionality of the holster 100.

Figure 4:
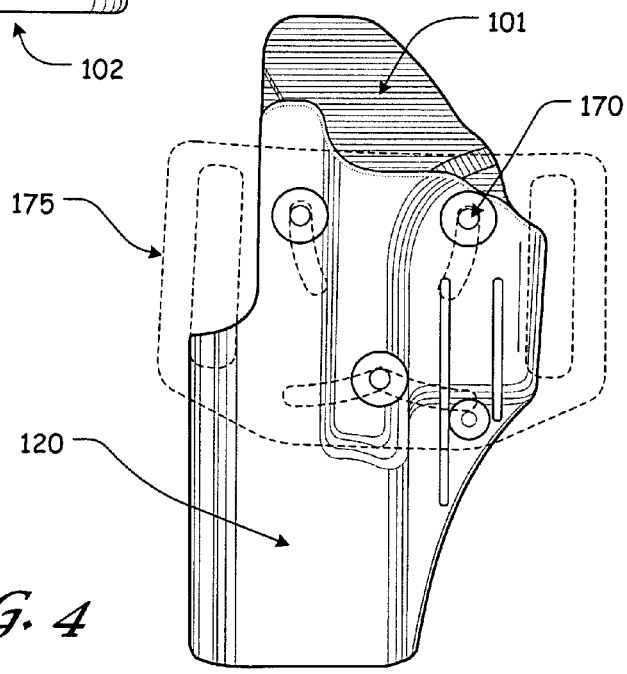
FIG. 4 shows a left side elevation view of a first exemplary embodiment of a handgun holster having a retention system according to this invention.
Figure 5:
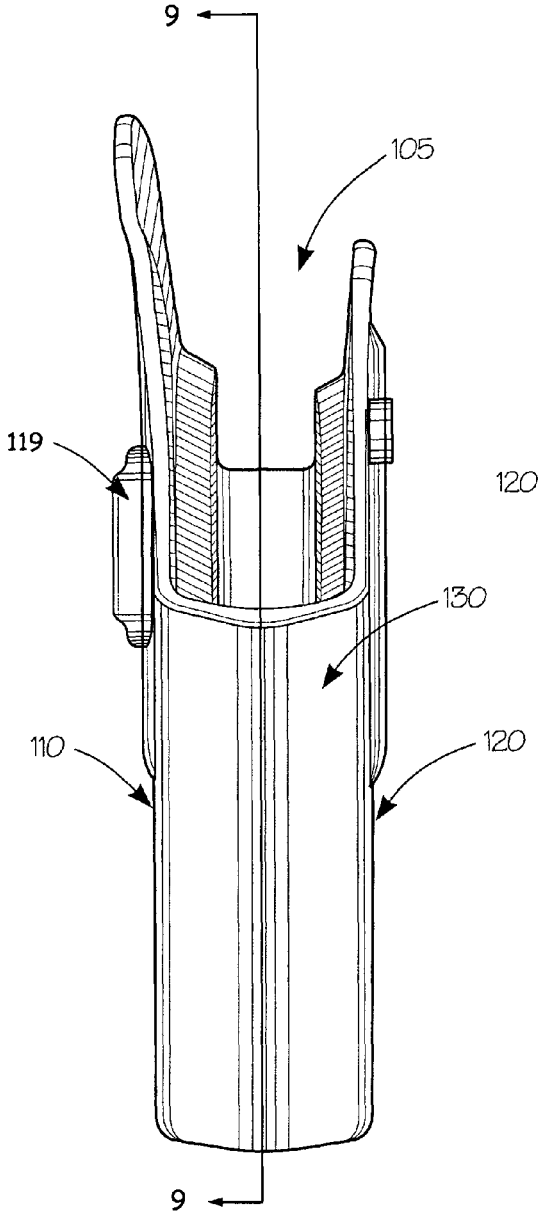
FIG. 5 shows a front elevation view of a first exemplary embodiment of a handgun holster having a retention system according to this invention.
Figure 6:
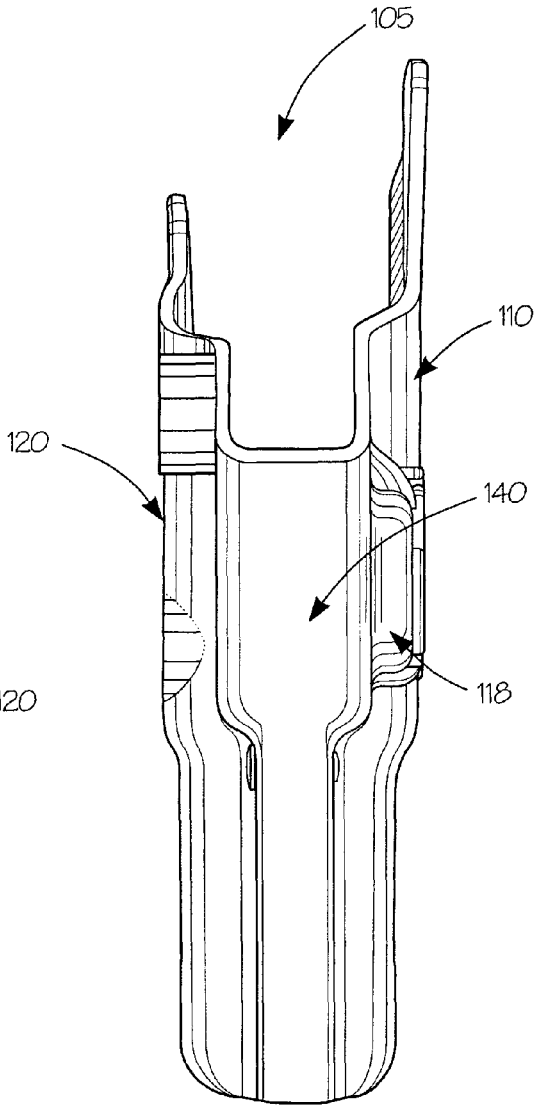
FIG. 6 shows a rear elevation view of a first exemplary embodiment of a handgun holster having a retention system according to this invention.
Figure 7:
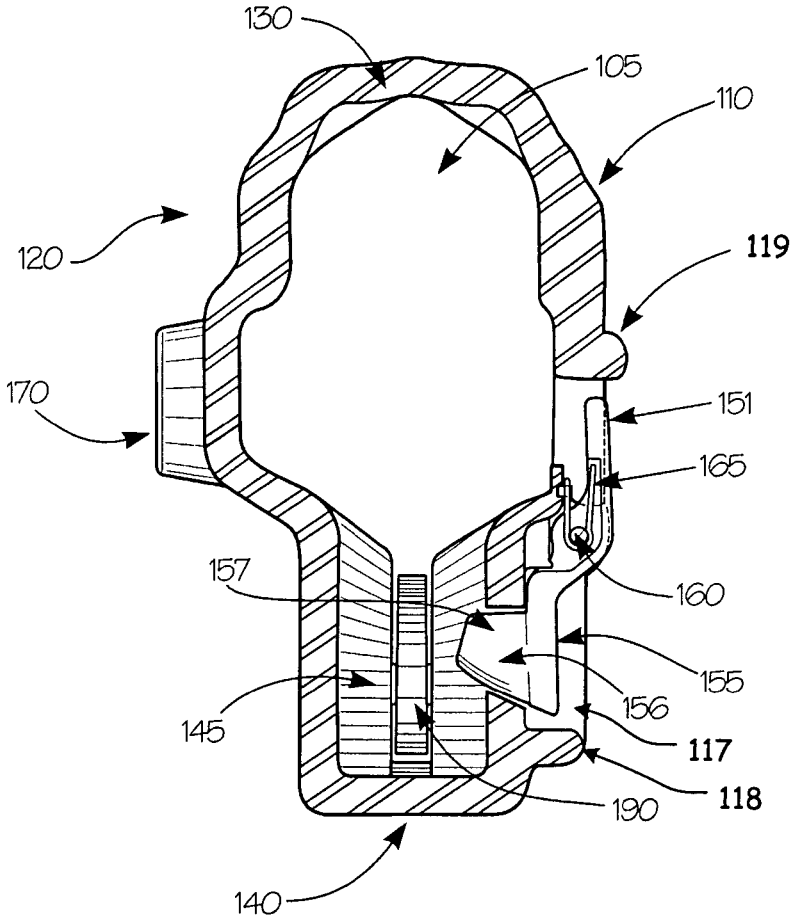
FIG. 7 shows a top cross-sectional view taken along line 7-7 of the handgun holster of FIG. 3, illustrating the first exemplary embodiment of the retention system according to this invention in greater detail.
Figure 8:
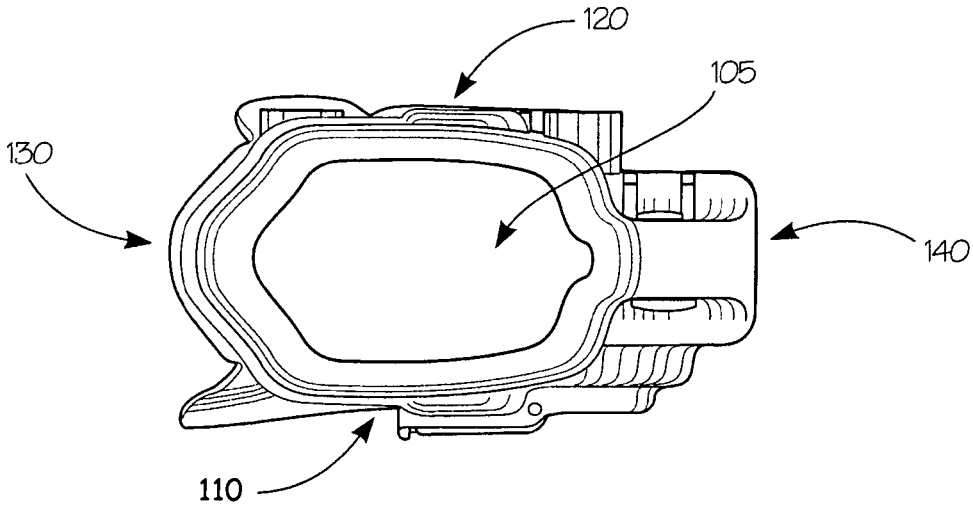
FIG. 8 shows a bottom plan view of a first exemplary embodiment of a handgun holster having a retention system according to this invention.
Figure 9A:
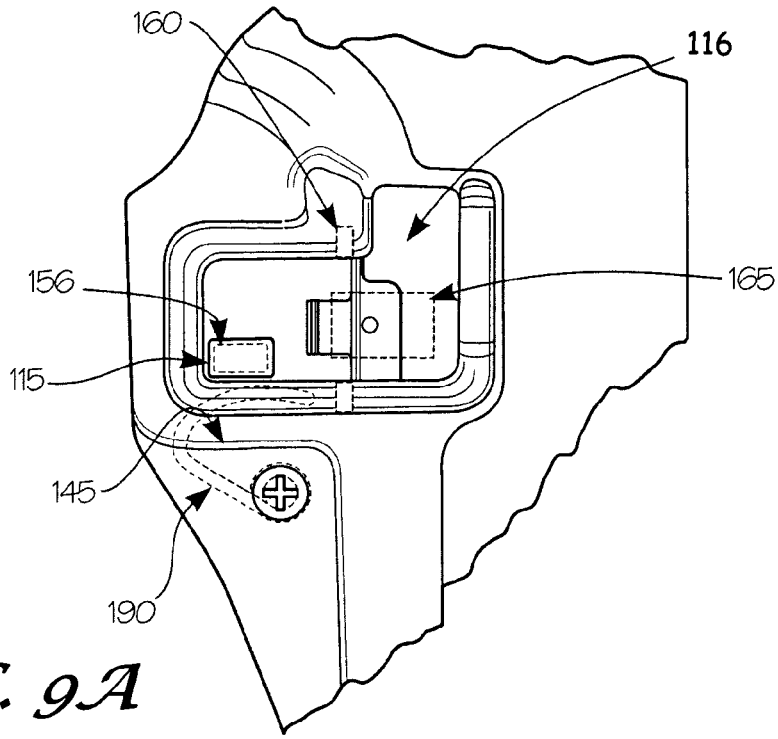
FIG. 9A shows a more detailed right side view of the handgun holster further illustrating the retention system according to this invention.
Figure 9B:
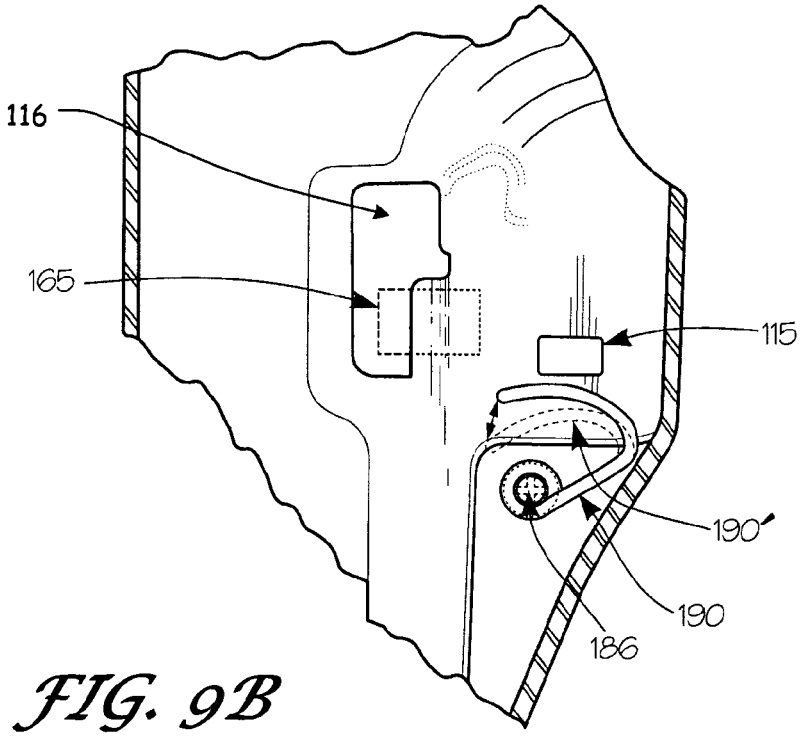
FIG. 9*b* shows a more detailed cross-sectional view taken along line 9-9 of the handgun holster of FIG. 5, illustrating the first exemplary embodiment of the retention system according to this invention in greater detail.

In various exemplary embodiments, the holster 100 includes attachment points 170, which provide means for fastening the holster to a holster holding device such as the holster holding device 175 illustrated in phantom in FIGS. 3 and 4. Alternatively, the means for fastening the holster may comprise a clip or hook adapted to be clipped over, for example, a belt. In further exemplary embodiments, means for fastening the holster may comprise one or more quick-disconnect or other couplings may be provided on or adjacent the second side wall 120 of the holster 100, which may be permanently or removably coupled to corresponding and cooperating coupling(s) provided on a belt or other carrier or platform. In still other exemplary embodiments, the holster 100 may comprise an integral belt, or may comprise one or more connections for attachment to a chest, ankle, leg, shoulder, or other harness or band, or for otherwise securing the holster to a user or the user's apparel.

In various exemplary embodiments, one or both of the side walls include optional slots 180 and 182, which define a passive retention portion 184. Although not shown in the present figures, the inner surface of the passive retention portion 184 may optionally include a raised area, which provides for additional frictional engagement of the trigger guard of the handgun. One or more retention screws 186 may be tightened or loosened to adjust the degree of frictional retention of the handgun by the passive retention portion 184.

The passive retention portion 184, if included, may be adjusted, via the one or more retention screws 186, to provide an adjustable frictional tension between the passive retention portion 184 and the handgun trigger guard, without increasing the frictional tension between a remaining portion of the holster 100 and the handgun.

As further shown in FIGS. 1-9B, the holster 100 comprises a retention means that is capable of retaining a handgun securely in the holster 100 by restricting withdrawal of the handgun from the cavity 105 of the holster 100 while permitting a quick release of the handgun when the user requires. The retention means comprises a lever 150, having a first side facing generally outward from the holster 100, away from the cavity 105 formed by the holster 100, and a second side facing toward the cavity 105 formed by the holster 100. The lever 150 comprises at least some of a finger button end 151 and an engagement end 155.

In various exemplary embodiments, the first side of the finger button end 151 includes a textured portion (not shown). In this manner, the finger button end 151 may be distinguished tactilely from other portions of the lever 150 or the holster 100.

In various exemplary, non-limiting embodiments, lever 150 is pivotally connected to the first side wall 110, approximately between the finger button end 151 and the engagement end 155, via a fulcrum or pivot pin 160. In various exemplary embodiments, the pivot pin 160 is positioned substantially parallel to a vertical axis of the holster 100, substantially perpendicular to a vertical axis of the holster 100, at a substantially acute angle relative to a vertical axis of the holster 100, or at a substantially obtuse angle relative to a vertical axis of the holster 100. Thus, the pivot pin 160 may be positioned at any angle relative to a vertical axis of the holster 100.

The pivot pin 160 may extend all or part of the way across the width of the lever 150.

The lever 150 is pivotable between an engaged position for securing the handgun within the cavity 105 of the holster 100 and a disengaged position for removal of the handgun. In various exemplary embodiments, the lever 150 may pivot between the engaged position and the disengaged position.

In various exemplary embodiments, the lever 150 may be biased to an engaged position whether the handgun is present in the holster 100 or absent from the holster 100. In various exemplary embodiments, biasing of the lever 150 may be accomplished by, for example, a spring means 165.

The engagement end 155 of the lever 150 includes a locking projection 156, formed on the second side of the engagement end 155. In certain exemplary embodiments, the locking projection 156 optionally extends substantially perpendicularly from the second side of the engagement and 155.

In various exemplary, nonlimiting embodiments, the locking projection 156 includes a ramp surface 157 and is shaped generally to match the contour of a portion of the inner surface of the trigger guard. Regardless of the particular handgun used, the locking projection 156 should be shaped so that there is no possibility that the locking projection 156 can at any time contact the trigger of the handgun. When the handgun is pushed as far forward as possible into the holster 100 and the trigger guard has come to rest against the trigger guard support wall 145, there should be a space between the locking projection 156 and the trigger of the handgun.

When the lever 150 is in the engaged position, the locking projection 156 protrudes from the second side of the engagement end 155, into the cavity 105 formed in the holster 100, via an opening 115 in the first side wall 110. In this manner, the locking projection 156 may extend inside the cavity 105 and inside the trigger guard of a handgun that is placed into the holster 100 and, thereby, retain the handgun in the holster 100.

In various exemplary embodiments, the locking projection 156 protrudes into the cavity 105 for a distance that is less than the width of the trigger guard. Alternatively, the locking projection 156 may protrude into the cavity 105 for a distance that is equal to or greater than the width of the trigger guard.

In addition, when the lever 150 is in the engaged position and is retaining a handgun in place, the clearance between the locking projection 156 and the trigger guard support wall 145 should be such that there is room for the slight arc or plunger-type movement of the locking projection 156 when the finger button end 151 is depressed.

Thus, the retention means is automatically disengaged as the outer surface of the handgun's trigger guard contacts the locking projection 156 and is subsequently engaged when the inner surface of the trigger guard has passed the locking projection 156 and the handgun is appropriately retained in the holster 100.

As illustrated in FIGS. 1 and 3, the holster 100 can be divided, along an axis that extends from the pivot pin 160, along the first side wall 110 of the holster 100, into a frame/slide portion and a trigger guard portion. The frame/slide portion is contoured to accept at least a portion of a frame/slide of a handgun and the trigger guard portion is contoured to accept at least a portion of a trigger guard of a handgun. Thus, it can be seen that the finger button end 151 extends into the frame/slide portion of the holster and the engagement end 155 extends into the trigger guard portion of the holster 100.

As at least a portion of each holster 100 is formed to accommodate and securely retain a specific type of handgun. The construction of the holster 100 also prevents the locking projection 156 from contacting the trigger of the inserted handgun by limiting how far the handgun can be inserted into the holster 100.

In various exemplary embodiments, a trigger guard support wall 145 is generally formed by a portion of the body of the holster 100. The trigger guard support wall 145 is shaped generally to match the contours of at least a portion of the outer surface of the trigger guard. The trigger guard support wall 145 is formed so as to contact at least a portion of the outer surface of the trigger guard of the inserted handgun and further limit how far the handgun can be inserted into the holster 100.

The construction of the holster 100 further facilitates alignment of the trigger guard with the locking projection 156 by limiting lateral movement of the handgun with respect to the lever 150 and the locking projection 156 without preventing a user from easily holstering or drawing the handgun.

In various exemplary embodiments, an optional ridge 118 is formed in the first side wall 110 around at least a portion of the lever 150. Generally, the ridge does not contact the lever 150, but provides a perimeter around at least a portion of the lever 150 to reduce the likelihood that the lever 150 will be inadvertently manipulated and to aid in the proper placement of a user's finger on the finger button end 151 of the lever 150. The ridge 118 may include a textured portion (not shown), such that the ridge 118 may be distinguished tactilely from other portions of the holster 100 or the lever 150.

In various exemplary embodiments, the optional ridge 118 is comprised of one or more ridge segments 118 and/or 119 that are formed around at least a portion of the lever 150.

In various exemplary embodiments, a recess 117 is defined within the optional ridge 118 or ridge segments 118 and/or 119.

Although FIGS. 1-9B show the lever 150 connected to the first side wall 110, it should be appreciated that in various exemplary embodiments, the lever 150 may be connected to the second side wall 120.

In an illustrative, non-limiting embodiment of this invention, a biasing element 190 is optionally included. If included, the biasing element 190 extends towards the locking projection 156, covering substantially the entire distance between the trigger guard support wall 145 and the locking projection 156. In various exemplary embodiments, the biasing element 190 does not touch the locking projection 156.

It should be appreciated that any suitable spring mechanism may be used to form the biasing element 190. The overall size, shape, and thickness of the biasing element 190 will vary depending on the type and rigidity of the particular material used to form the biasing element 190.

The biasing element 190 is configured to contact the outer surface of the trigger guard and is spring-biased (as shown in phantom by 190') when the handgun is retained, or locked, in the holster. In a compressed position, the tension of the biasing element 190 biases the handgun outward and assists in maintaining contact between the locking projection 156 and the inner surface of the trigger guard.

Furthermore, the biasing element 190 may assist in removal of the handgun from the holster when the locking projection is disengaged from the trigger guard.

The biasing element 190 may be configured in a number of ways, and may be attached to the holster 100 by any suitable method. In one exemplary embodiment, the biasing element 190 is molded as an integral part of the holster 100.

An aperture 116 is formed in a portion of the first side wall 110, within the recess 117, beneath at least a portion of the finger button portion 151 of the lever 150. Among other things, the aperture 116 allows dirt and/or debris that may find its way under the finger button portion 151 of the lever 150 to be pushed into the cavity 105. In this manner, dirt and/or debris is not permitted to build up underneath the finger button portion 151 of the lever 150 and keep the finger button portion 151 from being depressed by a user.

During use of the holster 100 having a retention system, as a user begins to holster the handgun, the handgun is inserted into the cavity 105 of the holster, muzzle first, and is guided into position by at least some of the first side wall 110, the second side wall 120, the front wall 130, and the rear wall 140.

As the handgun is inserted further into the cavity 105, the outer surface of the trigger guard will contact the ramp surface 157 of the locking projection 156. The shape of the ramp surface 157 allows the locking projection 156 to ride along the surface of the trigger guard and displace the locking projection 156 of the lever 150. As the locking projection 156 rides along the surface of the trigger guard, the bias of the lever 150 is overcome and the lever 150 is pivoted towards the disengaged position and the handgun is permitted to be seated in the cavity 105 of the holster. The trigger guard is prevented from moving in a direction opposite the locking projection 156 by the position of the first side wall 110 and the second side wall 120.

As the handgun is further seated into the holster, the trigger guard continues to displace the locking projection 156 and the lever 150 continues to pivot until the trigger guard passes a point of contact with a farthest extent of the locking projection 156 and clears the locking projection 156. When the trigger guard passes the locking projection 156, the lever 150 may be biased, via the spring means 165, to pivot back to the engaged position.

Thus, the handgun is secured in the cavity 105 of the holster by operation of the locking projection 156 blocking removal of the handgun, via the inner surface of the trigger guard. While the handgun is fully seated in the cavity 105 of the holster 100 with the lever 150 biased to the engaged position, removal of the handgun is not permitted, as the locking projection 156 does not allow the trigger guard to pass by. When the handgun is secured in place, removal force applied to the handgun will not remove the handgun from the holster 100 unless the finger button end 151 is pivoted and the locking projection 156 is brought out of the way of the inner surface of the trigger guard.

In order to release and unholster the handgun, the user depresses the finger button end 151 of the lever 150, pivoting the finger button end 151 towards the cavity 105. At some point, the first side wall 110 will stop the inward movement of the finger button end 151, thus eliminating the possibility that the finger button end 151 can prevent the removal of the handgun by contacting the trigger or constricting the trigger guard.

As the finger button end 151 of the lever 150 is depressed, the bias of the lever 150 is overcome, the lever 150 is pivoted towards the disengaged position, and the locking projection 156 of the engagement end 155 is at least partially withdrawn from the opening 115 and out of the holster cavity 105.

When the finger button end 151 has been depressed sufficiently, such that the locking projection 156 of the engagement end 155 is sufficiently withdrawn from the holster cavity 105, such that the locking projection 156 clears the inner surface of the trigger guard, the handgun's trigger guard will no longer be blocked by the locking projection 156, and the handgun can be withdrawn from the holster 100.

In various exemplary embodiments wherein the first side wall 110 is worn away from the user's body and the second side wall 120 is worn adjacent the user's body, the finger button end 151 may be positioned such that, as the finger button end 151 is depressed, the user's index finger is positioned along the frame of the handgun, between the trigger guard and the slide. Therefore, as the handgun is withdrawn from the holster 100 the user's index finger is positioned to contact the frame of the handgun, above the trigger guard, and not the trigger guard or the trigger.

The holster 100, as shown and described with reference to FIGS. 1-9B, is oriented such that the first side wall 110 is worn away from the user's body and the second side wall 120 is worn adjacent the user's body, such that the lever 150 is generally accessible by the user's index finger. However, in various other exemplary embodiments, the first side wall 110 is oriented to be worn adjacent the user's body and the second side wall 120 is oriented to be worn away from the user's body. In these exemplary embodiments, the lever 150 is generally accessible by the user's thumb.

Figure 10A:
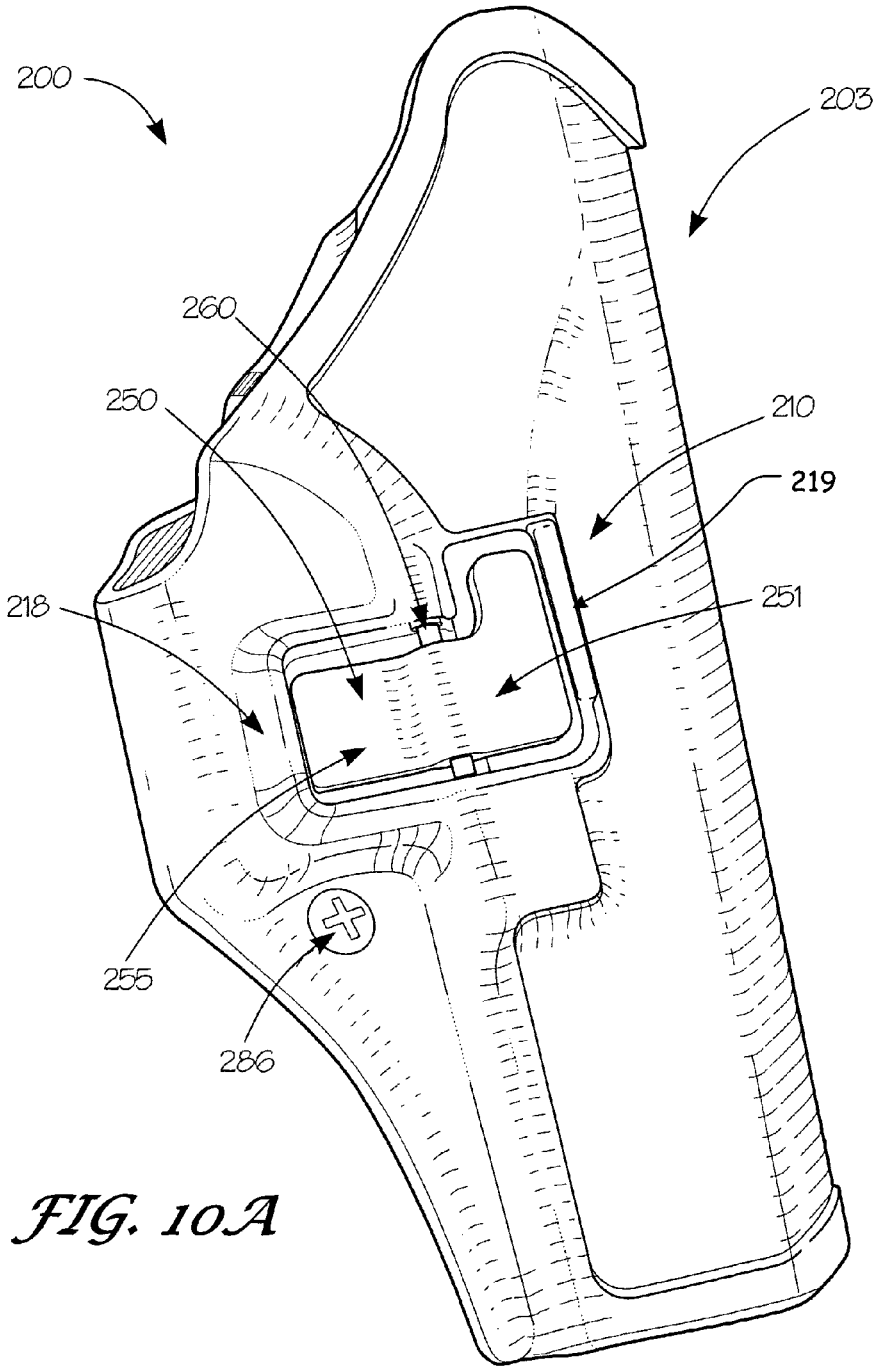
FIG. 10A shows a right perspective view of a second exemplary embodiment of a handgun holster having a retention system according to this invention.
Figure 10B:
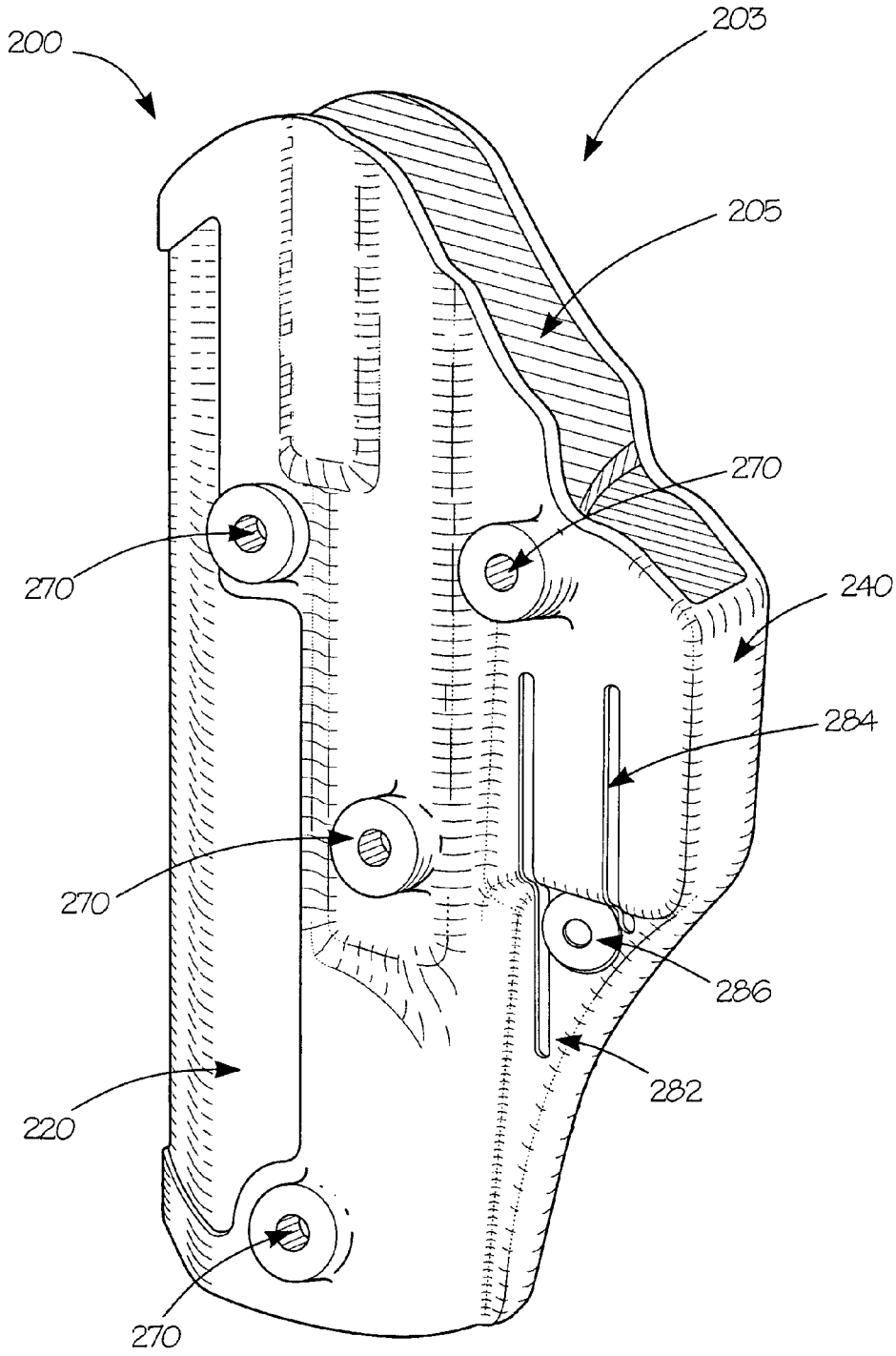
FIG. 10B shows a left perspective view of a second exemplary embodiment of a handgun holster having a retention system according to this invention.

FIGS. 10A and 10B show a right perspective view and a left perspective view, respectively, of a second exemplary embodiment of a handgun holster 200 having a retention system according to this invention. As shown in FIGS. 10A and 10B, the handgun holster 200 includes a body 203 defining a cavity 205 for receiving and holding the handgun. The body 203 comprises a pair of opposed side walls comprising a first side wall 210, an optional ridge 218 and/or ridge segments 218 and/or 219, a second side wall 220, a front wall 230, and a rear wall 240. The handgun holster 200 further comprises attachment points 270, optional slots 284 and 282, a passive retention screw 286, and a retention means comprising a lever 250.

It should be understood that each of these elements corresponds to and operates similarly to the body 103, the cavity 105, the first side wall 110, the optional ridge 118 and/or ridge segments 118 and/or 119, the second side wall 120, the front wall 130, the rear wall 140, the attachment points 170, the optional slots 180 and 182, the passive retention screw 186, the retention means, and the lever 150, as described above with reference to FIGS. 1-9B.

However, as shown in FIGS. 10A and 10B, the first side wall 210, the second side wall 220, and the front wall 230 of the handgun holster are extended, as compared to the holster 100.

The extended first side wall 210, second side wall 220, and front wall 230 perform at least three functions. First, the extended walls more fully surround and protect the handgun when the handgun is secured in the holster 200. Second, the extended walls serve to help better guide a handgun into the holster 200. Third, the extended walls serve to add a measure of strength and rigidity to the entire structure of the holster 200.

Figure 11A:
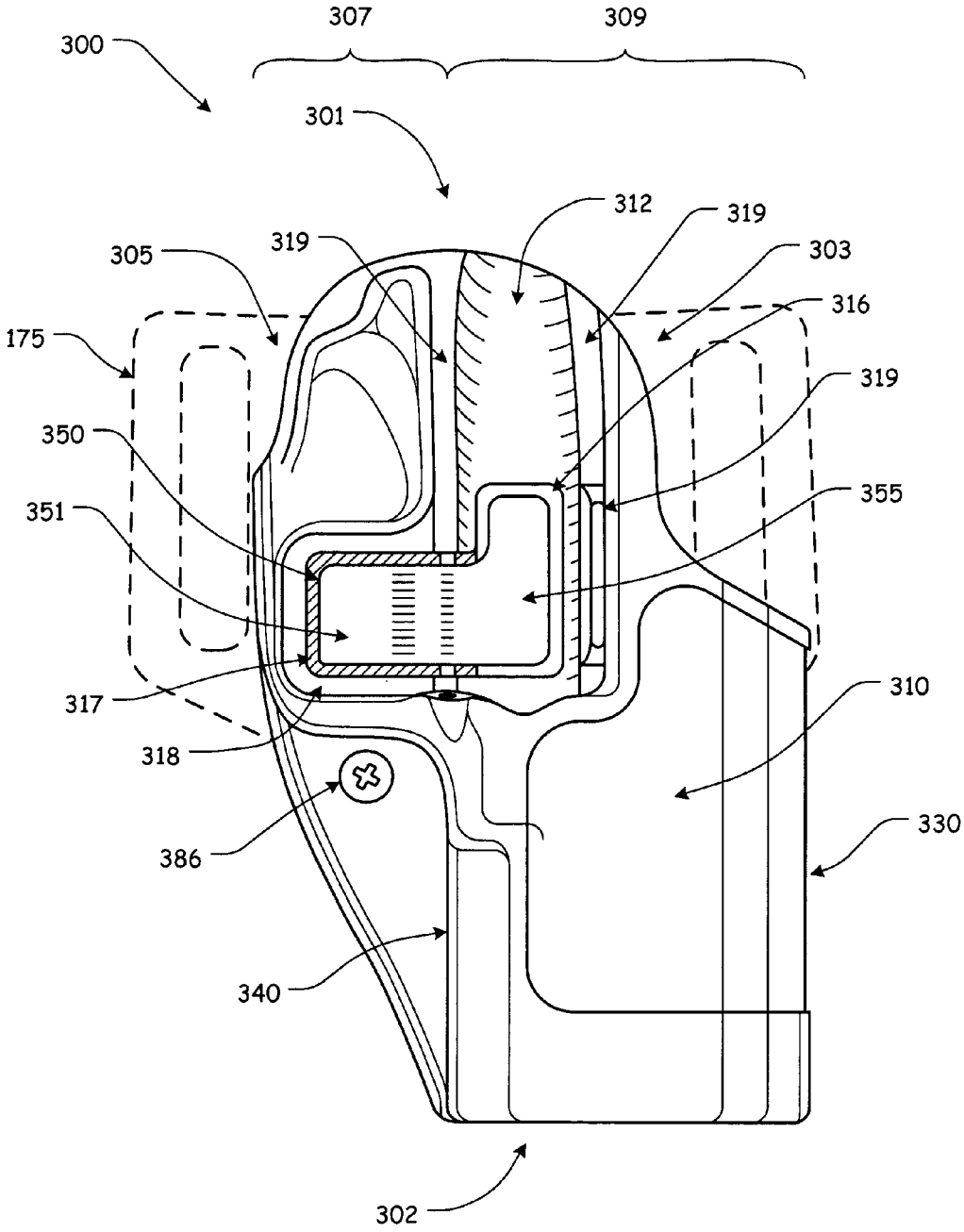
FIG. 11A shows a right side elevation view of a third exemplary embodiment of a handgun holster having a retention system according to this invention.
Figure 11B:
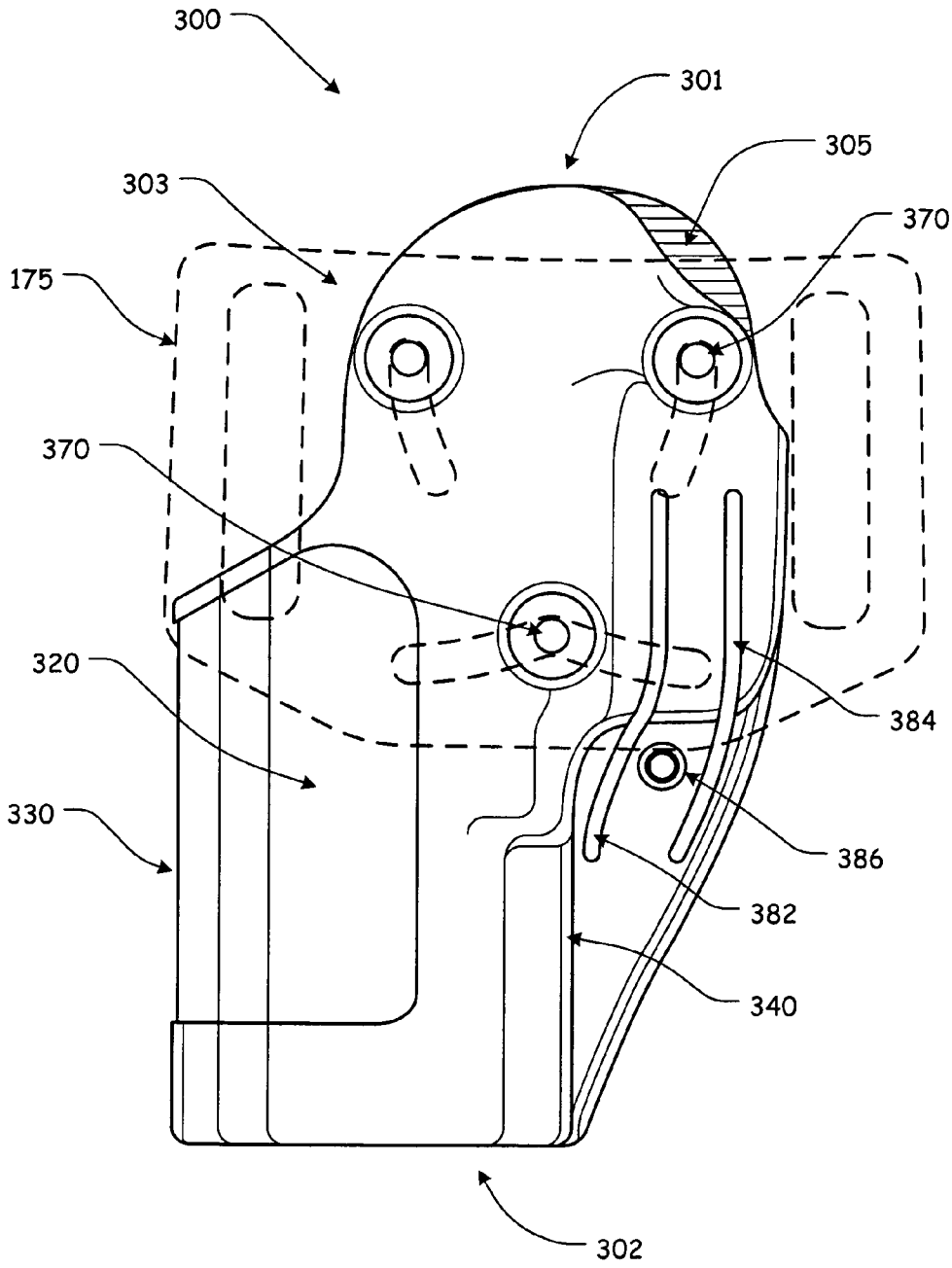
FIG. 11B shows a left side elevation view of a third exemplary embodiment of a handgun holster having a retention system according to this invention.

FIGS. 11A and 11B show a right perspective view and a left perspective view, respectively, of a second exemplary embodiment of a handgun holster 300 having a retention system according to this invention. As shown in FIGS. 11A and 11B, the handgun holster 300 includes a body 303 defining a cavity 305 (having a trigger guard portion 307 and a frame/slide portion 309) for receiving and holding the handgun.

The body 303 comprises a pair of opposed side walls comprising a first side wall 310, an aperture 316, a recess 317, an optional ridge 318 and/or ridge segments 318 and/or 319, a second side wall 320, a front wall 330, and a rear wall 340. The handgun holster 300 further comprises attachment points 370, optional slots 384 and 382, a passive retention screw 386, and a retention means comprising a lever 350 having a finger button end 351 and an engagement end 355.

It should be understood that each of these elements corresponds to and operates similarly to the body 103 and/or 203, the cavity 105 and/or 205, the first side wall 110 and/or 210, the aperture 116 and/or 216, the recess 117 and/or 217, the optional ridge 118 and/or 218, the optional ridge segments 118 and/or 119 and/or 218 and/or 219, the second side wall 120 and/or 220, the front wall 130 and/or 230, the rear wall 140 and/or 240, the attachment points 170 and/or 270, the optional slots 180 and 182 and/or 280 and 282, the passive retention screw 186 and/or 286, the retention means, and the lever 150 and/or 250 having the finger button end 151 and/or 251 and the engagement end 155 and/or 255, as described above with reference to FIGS. 1-10B.

However, as shown in FIGS. 11A and 11B, the first side wall 310, the second side wall 320, and the front wall 330 of the handgun holster 300 are slightly different from the respective side walls and front wall of the handgun holsters 100 and 200.

Additionally, as shown in FIGS. 11A and 11B, the optional ridge segments 319 extend from the finger button and 355 of the lever 350 to the top of the first side wall 310. A trough 312 is formed between the ridge segments 319, so as to further aid in the proper placement of a user's finger on the finger button end 351 of the lever 350. It should be should appreciate that the ridge segments 319 may include a textured portion (not shown), such that the ridge segments 319 may be distinguished tactilely from other portions of the holster 300 or the lever 350.

While this invention has been described in conjunction with the exemplary embodiments outlined above, it is evident that many alternatives, modifications, and variations will be apparent to those skilled in the art. Such adaptations and modifications should and are intended to be comprehended within the meaning and range of equivalents of the disclosed exemplary embodiments. It is to be understood that the phraseology of terminology employed herein is for the purpose of description and not of limitation. Accordingly, the foregoing description of the exemplary embodiments of the invention, as set forth above, are intended to be illustrative, not limiting. Various changes, modifications, and/or adaptations may be made without departing from the spirit and scope of this invention.

What is claimed is:

1. A holster for a handgun, comprising:

a cavity having an open top end, a bottom end, a frame/slide portion and a trigger guard portion, wherein said frame/slide portion of said cavity has greater depth than said trigger guard portion of said cavity;

an axis extending between said frame/slide portion of said cavity and said trigger guard portion of said cavity;

a lever having a finger button portion and an engagement portion, wherein said lever includes a second side facing generally toward said holster cavity, and wherein said engagement portion of said lever includes a locking projection extending from said second side of said engagement portion;

wherein said lever is pivotally attached atop said side wall of said holster, along said axis, approximately between said finger button portion and said engagement portion, such that said finger button portion extends from said axis and is positioned above said frame/slide portion of said cavity and said engagement portion extends from said axis and is positioned above said trigger guard portion of said cavity;

one or more ridge segments extending from said side wall around at least a portion of said lever so as to define a recess, wherein said lever is positioned within said recess; and an aperture formed in a portion of said side wall beneath at least a portion of said finger button portion of said lever, wherein said aperture is formed within said recess.

2. The holster of claim 1, wherein said frame/slide portion is contoured to accept at least a portion of a frame/slide of a handgun and said trigger guard portion is contoured to accept at least a portion of a trigger guard of a handgun.

3. The holster of claim 1, wherein said lever is pivotally attached to said side wall.

4. The holster of claim 1, wherein said lever is pivotally attached to one or more ridge segments.

5. The holster of claim 1, further comprising a front wall further defining said holster cavity.

6. The holster of claim 1, further comprising a rear wall further defining said holster cavity.

7. The holster of claim 1, wherein a first side wall is worn away from a user's body and a second side wall is worn adjacent said user's body.

8. The holster of claim 1, wherein a first side wall is worn adjacent a user's body and a second side wall is worn away from said user's body.

9. The holster of claim 1, wherein said holster is substantially rigid.

10. The holster of claim 1, further including at least one means for attaching said holster to a holster holding device.

11. The holster of claim 1, further comprising one or more slots, wherein said slots define a passive retention portion for providing frictional retention of said handgun by said passive retention portion and wherein one or more retention screws may be tightened or loosened to adjust said frictional retention between said passive retention portion and at least a portion of said handgun.

12. The holster of claim 1, wherein said locking projection includes a ramp surface.

13. The holster of claim 1, wherein said lever is pivotable between an engaged position and a disengaged position.

14. The holster of claim 13, wherein said lever is biased to said engaged position.

15. The holster of claim 1, further including a trigger guard support wall formed in said trigger guard portion to limit insertion of a handgun into said holster cavity.

16. The holster of claim 1, wherein when said lever is in said engaged position, said locking projection protrudes into said holster cavity, via an opening in said side wall such that said locking projection extends inside said holster cavity and when said lever is in said disengaged position, said locking projection is at least partially withdrawn from said holster cavity.

17. A holster for a handgun, comprising:

a cavity having a frame/slide portion and a trigger guard portion, wherein said frame/slide portion of said cavity has greater depth than said trigger guard portion of said cavity;

an axis extending between said frame/slide portion of said cavity and said trigger guard portion of said cavity;

a lever having a finger button portion and an engagement portion, wherein said lever includes a second side facing generally toward said holster cavity, and wherein said engagement portion of said lever includes a locking projection extending substantially perpendicularly from said second side of said engagement portion;

a ridge extending from said side wall around at least a portion of said lever so as to define a recess, wherein said lever is positioned within said recess;

wherein said lever is pivotally connected, via a pivot pin that pivots along said axis, atop said side wall of said holster, along said axis, approximately between said finger button portion and said engagement portion, such that said finger button portion extends from said axis and is positioned above said frame/slide portion of said cavity and said engagement portion extends from said axis and is positioned above said trigger guard portion of said cavity; and an aperture formed in a portion of said side wall beneath at least a portion of said finger button portion of said lever, wherein said aperture is formed within said recess.

18. The holster of claim 17, wherein said lever is pivotable between an engaged position and a disengaged position.

19. The holster of claim 17, wherein when said lever is in said engaged position, said locking projection protrudes into said holster cavity, via an opening in said side wall such that said locking projection extends inside said holster cavity and when said lever is in said disengaged position, said locking projection is at least partially withdrawn from said holster cavity.

20. A holster for a handgun, comprising:

a cavity having a frame/slide portion and a trigger guard portion, wherein said frame/slide portion of said cavity has greater depth than said trigger guard portion of said cavity;

an axis extending between said frame/slide portion of said cavity and said trigger guard portion of said cavity; and a lever having a finger button portion and an engagement portion, wherein said lever includes a second side facing generally toward said holster cavity, and wherein said engagement portion of said lever includes a locking projection extending from said second side of said engagement portion;

wherein said lever is pivotally attached to said side wall of said holster, along said axis, approximately between said finger button portion and said engagement portion, such that said finger button portion extends from said axis and is positioned above said frame/slide portion of said cavity and said engagement portion extends from said axis and is positioned above said trigger guard portion of said cavity;

wherein said lever is positioned atop said side wall of said holster and is pivotable between an engaged position and a disengaged position;

a ridge extending from said side wall around at least a portion of said lever so as to define a recess, wherein said lever is positioned within said recess; and an aperture formed in a portion of said side wall beneath at least a portion of said finger button portion of said lever, wherein said aperture is formed within said recess;

wherein, when said lever is in said engaged position, said locking projection protrudes into said holster cavity, via an opening in said side wall.

* * * * *